United States Patent [19]

Myers et al.

[11] Patent Number: 4,593,895

[45] Date of Patent: Jun. 10, 1986

[54] AUTOMATICALLY ADJUSTING CURRENCY PUSHER PLATE APPARATUS

[75] Inventors: Kimbrough I. Myers, Dayton; Carl C. Blau, West Carrollton; Richard P. Taylor, Xenia, all of Ohio

[73] Assignee: NCR Corporation, Dayton, Ohio

[21] Appl. No.: 597,339

[22] Filed: Apr. 6, 1984

[51] Int. Cl.[4] ..... B65H 1/08; B65H 1/02

[52] U.S. Cl. ..... 271/148; 271/162; 271/164; 271/149; 414/30

[58] Field of Search ..... 271/147-149, 271/150, 160, 162, 164, 31.1, 129, 219, 214; 414/30, 118; 221/279, 227

[56] References Cited

U.S. PATENT DOCUMENTS

| | | | |
|---|---|---|---|
| 622,106 | 3/1899 | Berry | 271/31.1 |
| 3,705,665 | 12/1972 | Gunzler | 221/279 |
| 3,919,972 | 11/1975 | Komori et al. | 271/160 |
| 3,954,260 | 5/1976 | Morello et al. | 271/12 |
| 4,151,987 | 5/1979 | Toriumi et al. | 271/129 |
| 4,302,000 | 11/1981 | Frank | 271/150 |
| 4,332,348 | 6/1982 | Nordin | 271/180 |
| 4,398,088 | 8/1983 | Hirose et al. | 235/379 |

*Primary Examiner*—Bruce H. Stoner, Jr.
*Assistant Examiner*—John A. Carroll
*Attorney, Agent, or Firm*—Albert L. Sessler, Jr.; Elmer Wargo

[57] ABSTRACT

A cassette for use with a cash dispensing machine having a picker assembly including first and second pickers, for example, for picking bills from the cassette when the cassette is placed into operative engagement with the cash dispensing machine. The cassette is used to receive a stack of bills having a front end and a rear end, with the cassette having a dispensing end which is positioned next to the picker assembly. The cassette utilizes first and second resilient pushers that are aligned with the first and second pickers to move the stack of bills towards the dispensing end. Each of the first and second resilient pushers includes a ball and socket joint which enable the pushers to conform to the rear end of the stack and thereby obviate a current "wedging" problem associated with cassettes.

10 Claims, 4 Drawing Figures

AUTOMATICALLY ADJUSTING CURRENCY PUSHER PLATE APPARATUS

BACKGROUND OF THE INVENTION

This invention relates, generally, to containers in which stacks of sheets are stored, and more particularly, it relates to an apparatus for automatically maintaining pressure at certain locations on the rear of a stack of sheets so as to facilitate the dispensing of sheets via pickers, for example, at the front end of the stack.

The cash dispensing machines or Automated Teller Machines (ATMs) in use today, generally use containers or currency cassettes in which stacks of currency are stored. Generally, one cassette holds a stack of one denomination of currency. When the cassette is installed in an ATM, its dispensing end is positioned therein to enable a "picker mechanism" in the ATM to "pick" the front sheet or bill from the stack of bills in the cassette as part of a cash dispensing operation. Most cassettes have a simple pusher plate located therein which is used to resiliently bias the stack of sheets towards the dispensing end of the cassette as bills are picked from the stack in normal cash dispensing operations by the ATM. The cassettes are also used in Teller Assist Currency Dispensers (TACD) which facilitate the counting of currency to be dispensed by human tellers.

One of the problems which develops with cassettes of the type mentioned in the previous paragraph is that of "wedging". The wedging problem is due, basically, to the way in which currencies are made. For example, when a particular bill or note is embossed or printed, the embossing or printing may be heavier or more pronounced on one side or end of the note than on the other side or end. Although the variation or increase in thickness is slight for one bill or note, the variations accumulate rapidly when several hundred such bills are formed into a stack in the cassette. This results in the "wedging" problem mentioned (as shown in FIG. 1), in that one side, for example, of the rear of the stack is not pushed towards the dispensing end of the cassette by the associated pusher plate.

This wedging problem is not predictable in any way; it varies with the currency of one country, with currency denominations, and even with new and old currency of that country. Some foreign currencies also experience severe wedging problems in more than one direction when stacked in a cassette; this is due, generally, to the currency having more than one thick area on the bill.

One current method of solving the wedging problem mentioned is to alternate the orientation of the notes or bills as they are formed into a stack in the cassette. This method makes loading the cassettes more difficult and time consuming than loading without regard to orientation. If the process of alternating the orientation of the notes is forgotten, or done incorrectly, serious problems are created when a cassette, so loaded, is placed in an ATM, for example, because the "picker mechanism" associated with the ATM will fail to "pick" the bills from the cassette.

SUMMARY OF THE INVENTION

A preferred embodiment of this invention comprises a container for receiving a stack of sheets having a front end and a rear end. The container has a dispensing end and also comprises: means for supporting said stack of sheets in said container; and means for moving said stack of sheets towards said dispensing end as a first sheet at said front end is removed therefrom. The moving means comprises: a first member positioned at said rear end when said stack of sheets is positioned in said container; at least one second member for contacting said rear end of said stack of sheets; and means for resiliently coupling said second member with said first member to enable said second member to move with respect to a plurality of axes while resiliently urging said stack of sheets towards said dispensing end.

An advantage of the present invention is that it obviates the "wedging" problem mentioned earlier herein.

Other advantages of this invention are that: it is economical to produce; it is simple to construct; and it adapts to the various currencies used in ATMs and TACDs throughout the world.

These advantages and others will be more readily understood in connection with the following specification, claims, and drawing.

DETAILED DESCRIPTION OF THE INVENTION

Figure 1:
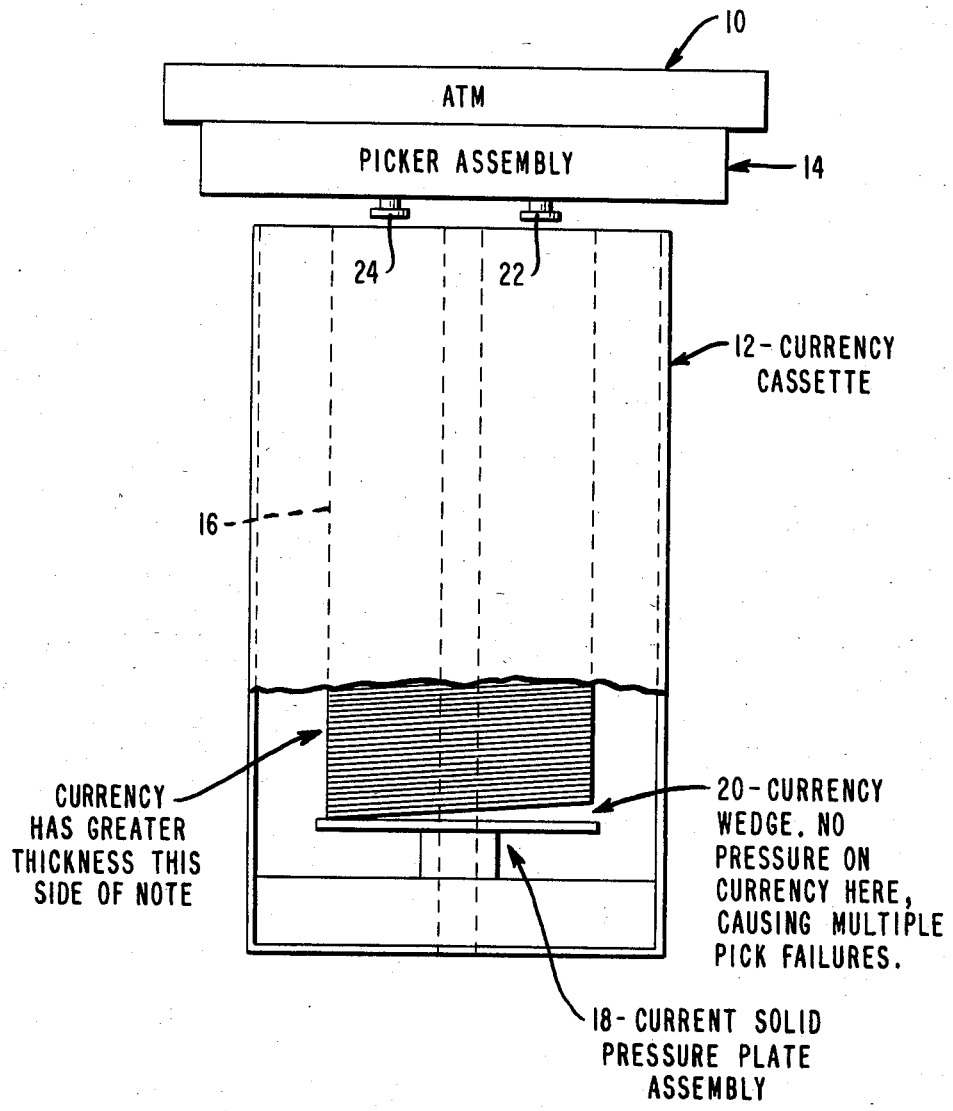
FIG. 1 PRIOR ART
FIG. 1 is a diagrammatic showing of an Automated Teller Machine (ATM) having a prior art cassette positioned therein, with the cassette shown in plan view to illustrate the wedging problem mentioned earlier herein; the top, long edges of the sheets or bills are seen in this view.

FIG. 1 is a diagrammatic showing of an automated teller machine (ATM) 10 having a prior art cassette 12 positioned therein, with the cassette 12 being positioned in operative engagement with the picker assembly 14 of the ATM 10. As viewed in FIG. 1, the bills are stacked on their long, lower edges, and the top long edges of the bills are seen. Each of the individual bills forming the stack 16 of bills has a greater thickness on the left side than on the right side thereof, in the example shown. As a result, the solid pressure plate assembly 18 does not push evenly across the rear of the stack 16 of bills, and a currency wedge is formed at area 20. The currency wedge at area 20 means that the right side of the stack 16 is not pushed into operative engagement with the picker 22 on the right side of the picker assembly 14. The picker 24 on the left side of the picker assembly 14 and the picker 22 are used together to pick the first bill in the stack 16 and transfer it to a transport mechanism (not shown) associated with the ATM 10 to thereby dispense currency in a conventional, routine manner. The pickers 22 and 24 may be vacuum operated, for example, and if one of these pickers is not in operative contact with the first bill in the stack 16, a malfunction in the picking operation may occur.

Figure 2:
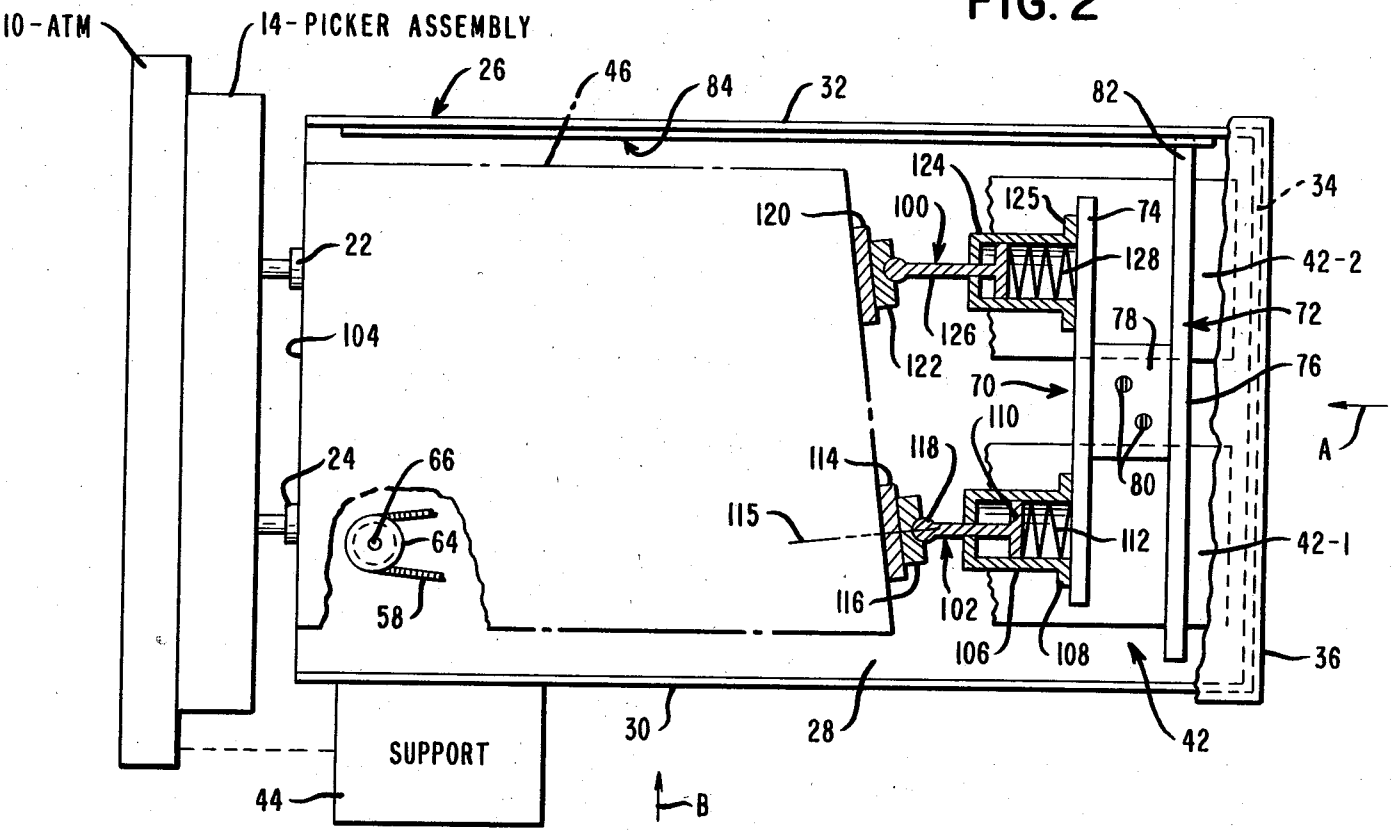
FIG. 2 is a view similar to that shown in FIG. 1; however, the container of this invention is shown therein.

In contrast with the prior art cassette 12 shown in FIG. 1, the container or cassette of this invention is designated generally as 26 and is shown in plan view in FIG. 2. Certain portions of the elements of the cassette 26 are removed in FIG. 2, and certain elements are shown in cross-section to facilitate a showing of the cassette 26.

Figure 4:
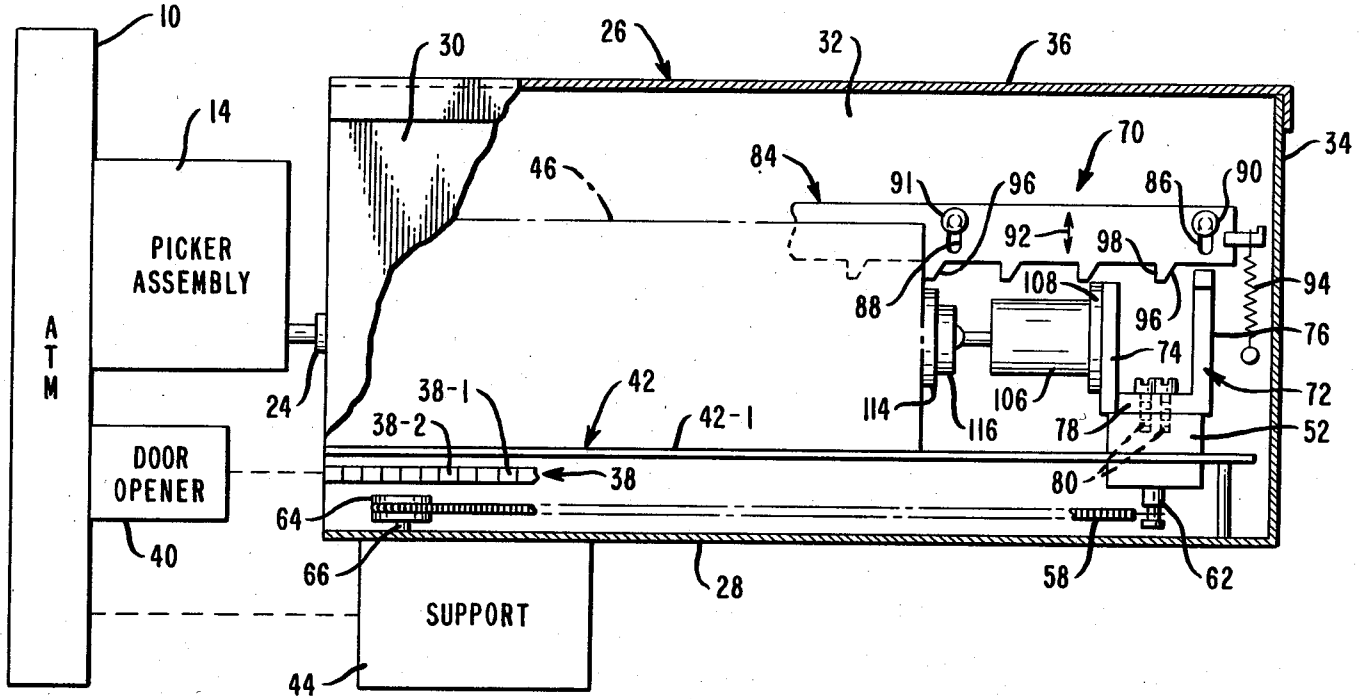
FIG. 4 is a side view, in elevation, of the container as it appears when looking from the direction B of FIG. 2; the side wall is removed to show the interior of the container.

The cassette 26 is shown in operative engagement with an ATM 10 in FIGS. 2 and 4. The cassette 26 includes a floor panel 28, side panels 30 and 32, end panel 34, a removable, cover panel 36, and a door panel 38 (FIG. 4). The door panel 38 is of the "garage door" type that is made of a plurality of hinged slats or panels like 38-1 and 38-2, for example. The door panel 38 usually closes the dispensing end of the cassette 26; however, when the cassette 26 is moved into operative engagement with the ATM 10, a door opener 40 on the ATM 10 coacts with the cassette 26 to move the door panel 38 under the support floor 42 as the cassette 26 is moved to the operative position shown in FIG. 4. The cassette 26 is guided and supported on guide rails, for example, which are shown schematically as support 44 in FIG. 4. There are various interlocks coupled between the cassette 26 and the ATM 10 to prevent the cassette 26 from being removed from the ATM 10 while the door panel 38 is in the open position shown in FIG. 4; however, because the interlocks are conventional and are not important to an understanding of this invention, they are not shown.

Figure 3:
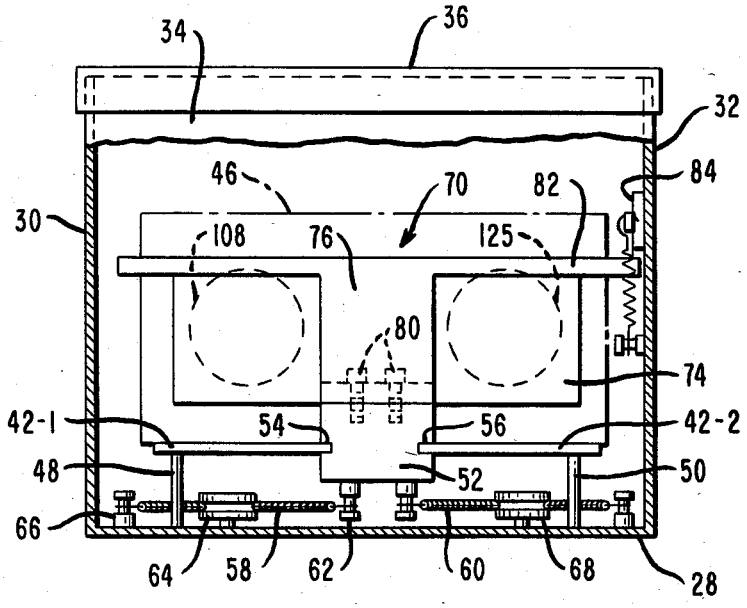
FIG. 3 is an end view, in elevation, of the container as it appears when looking from the direction A of FIG. 2; the end wall is removed to show the interior of the container.

The bills in the stack 46 have their long lower edges supported on the support floor 42 when loaded into the cassette 26. The support floor 42 is comprised of panels 42-1 and 42-2 which are spaced from the floor panel 28 by spacers 48 and 50, (FIG. 3) and the panels 42-1 and 42-2 are also spaced from each other to permit a block 52 to be slidably mounted therebetween, as shown in FIG. 3. The block 52 has aligned slots 54 and 56 therein to receive the panels 42-1 and 42-2, respectively. The block 52 is resiliently biased to the left, as viewed in FIG. 4, by tension springs 58 and 60. Tension spring 58 has one end thereof secured to a stud 62 that depends from the underside of block 52, and the length of the spring passes around a pulley 64 that is rotatably mounted on a stud that is secured to the floor panel 28. The remaining end of the spring 58 is secured to a stud 66 upstanding from the floor panel 28 as shown in FIG. 3. The spring 60 is similarly mounted around a pulley 68. By this construction, the block 52 is resiliently biased to the left, as viewed in FIG. 4.

The block 52 and the springs 58 and 60 are part of a means for moving the stack 46 of bills towards the dispensing end of the cassette 26; this moving means is designated generally as 70. The moving means 70 (FIG. 4) also includes a "U"-shaped member 72 which has spaced, parallel, vertically-positioned plates 74 and 76 that are connected by the joining portion 78. The joining portion 78 is secured to the block 52 by fasteners 80. The plate 76 has a long finger 82 (FIG. 3) extending therefrom, and this finger 82 coacts with a detent 84 that is mounted on the side panel 32, as seen best in FIG. 4. The detent 84 extends along the length of the side panel 32, and the detent 84 has spaced, elongated slots like 86 and 88 therein to receive stationary, headed pins 90 and 91, respectively; this construction enables the detent 84 to move in the directions of double arrow 92 (FIG. 4). The detent 84 is resiliently biased towards the floor panel 28 by a biasing mechanism shown schematically as a tension spring 94. The detent 84 has a plurality of detent teeth, each of which has an angled side 96 and an abutment side 98 as shown in FIG. 4. As the picker assembly 14 picks bills from the stack 46 during a normal, cash dispensing operation, the stack 46 becomes smaller, and the "U"-shaped member 72 is moved to the left (as viewed in FIG. 4) due to the urging of springs 58 and 60. While the cassette 26 is in the ATM 10, the detent 84 is out of operative engagement with the finger 82 by means not important to an understanding of this invention; however, the detent 84 is shown in its lower or operative position in FIG. 4. During this time when the cassette 26 is in the ATM 10, the "U"-shaped member 72 "oscillates" slightly as bills are picked from the stack 46. When the cassette 26 is removed from the ATM 10, the spring 94 pulls the detent 84 towards the floor panel 28 to enable one of the abutment sides, like 98, of the detent 84 to engage the finger 82 to provide an abutment for the "U"-shaped member 72. This construction maintains pressure on the stack 46 of bills in the cassette 26 during handling or transit of the cassette 26 from the associated bank or transit agent to an ATM 10 in which it is installed.

The moving means 70, described partially in the previous paragraphs, also includes a first member designated generally as 100 (FIG. 2); this member 100 is positioned between the plate 74 and the rear end of the stack 46 of bills, as shown in FIG. 2. Similarly, the moving means 70 includes a second member 102 that is also positioned between the plate 74 and the rear end of the stack 46, as shown in FIG. 2. The function of the members 100 and 102 is to supply pressure to the rear of the stack 46 while accommodating stacks of bills that produce various currency wedges as previously discussed in relation to FIG. 1. An important point to be stressed here is that there should be one member, like 100, for each picker, like 22. Also, the member 100 should be aligned in the cassette 26 so that it resiliently applies pressure towards its associated picker 22. Even though the stack 46 of bills forms a currency wedge as shown in FIG. 2, the first bill 104, shown as a line, is in firm contact with pickers 22 and 24 due to the pressure from members 100 and 102, respectively. This firm contact at each of the pickers 22 and 24 enables the first bill 104 in the stack 46 to be picked cleanly and also obviates the problems mentioned earlier. The cassette 26 has conventional restrainers (not shown) to restrain the dispensing end of the stack 46 of bills from moving to the left, as viewed in FIG. 2, while each first bill 104 is picked from the stack 46. The first bill 104 is then transferred by the picker assembly to transport mechanisms (not shown) associated with the ATM 10 for eventual dispensing to a customer of the ATM 10 in a conventional, routine, cash dispensing operation.

The first and second members 100 and 102 alluded to are identical. The second member 102 (FIGS. 2 and 4) includes a cylinder 106 having a flange 108 by which it is secured to the plate 74. The second member 102 is shown in cross-section in FIG. 2 to facilitate a showing thereof, with the viewing plane being through the center of the cylinder 106. A piston 110 is mounted in the cylinder 106 for reciprocal movement therein, with the rod of the piston 110 passing through the center of the cylinder 106. The piston 110 is biased to move away from the plate 74 by a compression spring 112 that is located within the cylinder 106 as shown.

The second member 102 also includes a planar member 114 that has a ball and socket joint 116 secured thereto as shown. The end of the rod of piston 110 is secured to the ball 118 in the socket joint 116. With the construction described, the planar member 114 is free to move with respect to a plurality of axes which pass through a common point located at the center of the ball 118; this enables the planar member 114 to conform or adapt to the rear of the stack 46, due to the currency wedge problem mentioned, while the second member 102 resiliently biases the stack towards the picker 24. Another way of looking at the cooperation between the planar member 114 and its associated ball 118 is that a line such as dashed line 115 (FIG. 2) that is perpendicular to planar member 114 and that is located along a radius of ball 118 will always pass through the center of ball 118 as the planar member 114 changes position to conform to the rear end of the stack 46 with regard to the currency wedge problem discussed in relation to FIG. 1. The first member 100 is identical in construction to the second member 102 already described, and the member 100 includes a planar member 120, a ball and socket joint 122, a cylinder 124, a flange 125, a piston 126, and a spring 128. The first member 100 resiliently biases the stack 46 towards the picker 22. The cylinder 124 is positioned on the plate 74 so as to align the reciprocating movement of piston 126 with the associated picker 22.

As first bills 104 are consecutively removed from the dispensing end of the cassette 26, the springs 58 and 60 (FIG. 3) resiliently bias the block 52 to the left (as viewed in FIG. 4) thereby moving planar member 74 and the first and second members 100 and 102 to the left to maintain the proper operative relationship with the pickers 22 and 24.

Some miscellaneous points of discussion appear in order. The first and second members 100 and 102 were made of metal in the preferred embodiment; however, other materials may be used in particular applications. While vacuum pickers 22 and 24 are discussed, the principles of this invention may be extended to machines using other forms of pickers.

What is claimed is:

1. A container for receiving a stack of sheets having a front end and a rear end; said container having a dispensing end and also comprising:

means for supporting said stack of sheets in said container; and means for moving said stack of sheets towards said dispensing end as a first sheet at said front end is removed therefrom;

said moving means comprising:

a first member positioned at said rear end when said stack of sheets is positioned in said container;

at least one second member for contacting said rear end of said stack of sheets; and means for resiliently coupling said second member with said first member to enable said second member to resiliently urge said stack of sheets towards said dispensing end;

said coupling means including a first element having a point therein; and also including a second element secured to said second member and cooperating with said first element to enable said second member to change position relative to said first element while contacting said rear end and while an imaginary line that is perpendicular to said second member passes through said point.

2. The container as claimed in claim 1 in which said coupling means also includes first means positioned between said first member and said first element for resiliently biasing said second member into engagement with said rear end to thereby move said stack of sheets towards said dispensing end.

3. The container as claimed in claim 2 in which said moving means also includes resilient means coupled between said container and said first member for resiliently biasing said first member towards said dispensing end.

4. The container as claimed in claim 1 in which said moving means includes:

a third member for contacting said rear end of said stack of sheets; and means for resiliently coupling said third member with said first member to enable said third member to resiliently urge said stack of sheets toward said dispensing end;

said third member being substantially identical to said second member; and said means for resiliently coupling said third member with said first member being substantially identical to said means for resiliently coupling said second member with said first member.

5. A container for receiving a stack of sheets having a front end and a rear end; said container having a dispensing end and also comprising:

means for supporting said stack of sheets in said container; and means for moving said stack of sheets towards said dispensing end as a first sheet at said front end is removed therefrom;

said moving means comprising:

a first member positioned at said rear end when said stack of sheets is positioned in said container;

at least one second member for contacting said rear end of said stack of sheets; and means for resiliently coupling said second member with said first member to enable said second member to resiliently urge said stack of sheets towards said dispensing end;

said coupling means including a first element having a point therein; and also including a second element secured to said second member and cooperating with said first element to enable said second member to change position relative to said first element while contacting said rear end and while an imaginary line that is perpendicular to said second member passes through said point;

said coupling means also including first means positioned between said first member and said first element for resiliently biasing said second member into engagement with said rear end to thereby move said stack of sheets towards said dispensing end;

said moving means also including resilient means coupled between said container and said first member for resiliently biasing said first member towards said dispensing end;

said first and second elements comprising a ball and socket joint and said point lying at the center of the ball of said ball and socket joint.

6. The container as claimed in claim 5 in which said first means comprises:

a cylinder secured to said first member;

a piston mounted in said cylinder, with said piston having a rod extending from said cylinder and also being secured to said ball; and a spring located in said cylinder between said first member and said piston to urge said piston towards said dispensing end.

7. A cassette for use with a cash dispensing machine; said machine having a picker assembly including first and second pickers for picking bills from said cassette when said cassette is placed into operative engagement with said cash dispensing machine;

said cassette being used to receive a stack of bills having a front end and a rear end; said cassette having a dispensing end which is positioned next to said picker assembly when said cassette is placed in said operative engagement with said cash dispensing machine;

said cassette comprising;

means for supporting said stack of bills in said cassette; and means for moving said stack of bills towards said dispensing end as a first bill at said front end is removed from said cassette by said first and second pickers;

said moving means comprising:

a first member positioned at said rear end when a stack of bills is positioned in said cassette;

a second member and a third member for contacting said rear end of said stack of bills; and first means and second means for resiliently coupling said second and third members, respectively, with said first member to resiliently urge said stack of bills towards said dispensing end; and each of said first and second means including a ball and socket joint.

8. The cassette as claimed in claim 7 in which said second and third members are located within said cassette so as to apply pressure to said rear end at first and second areas which are aligned with said first and second pickers, respectively.

9. The cassette as claimed in claim 8 in which said moving means also includes resilient means coupled between said cassette and said first member for resiliently biasing said first member towards said dispensing end.

10. The cassette as claimed in claim 9 in which said first means includes a mechanism for operatively connecting said first member with the ball of the associated said ball and socket joint to resiliently urge said second member into contact with said rear end; and in which said second means includes a mechanism for operatively connecting said first member with the ball of the associated said ball and socket joint to resiliently urge said third member into contact with said rear end.

* * * * *